US009222306B2

(12) United States Patent
Appling et al.

(10) Patent No.: US 9,222,306 B2
(45) Date of Patent: Dec. 29, 2015

(54) CRANE ACCESS STAIRCASE AND MOUNTING SYSTEM

(71) Applicant: TNT Crane & Rigging, Inc., Houston, TX (US)

(72) Inventors: Mike Appling, Houston, TX (US); Randy Dobbs, Manvel, TX (US)

(73) Assignee: TNT CRANE & RIGGING, INC., Houston, TX (US)

( * ) Notice: Subject to any disclaimer, the term of this patent is extended or adjusted under 35 U.S.C. 154(b) by 88 days.

(21) Appl. No.: 13/892,985

(22) Filed: May 13, 2013

(65) Prior Publication Data

US 2014/0332488 A1 Nov. 13, 2014

(51) Int. Cl.

| | |
|---|---|
| ***B66C 23/78*** | (2006.01) |
| ***E06C 5/24*** | (2006.01) |
| ***E06C 5/02*** | (2006.01) |
| ***B66C 13/52*** | (2006.01) |

(52) U.S. Cl.

CPC . *E06C 5/24* (2013.01); *B66C 13/52* (2013.01); *E06C 5/02* (2013.01); *B66C 23/78* (2013.01)

(58) Field of Classification Search

USPC ..... 212/291, 175, 294, 301, 302

See application file for complete search history.

(56) References Cited

U.S. PATENT DOCUMENTS

| | | | | |
|---|---|---|---|---|
| 1,444,759 | A | | 2/1923 | Traylor |
| 3,735,838 | A | * | 5/1973 | Greenleaf ..... 182/15 |
| 6,029,775 | A | * | 2/2000 | Hedley et al. ..... 182/127 |
| 7,354,050 | B2 | | 4/2008 | Brockway |
| 7,506,774 | B2 | | 3/2009 | Willim |
| 7,905,324 | B2 | | 3/2011 | Gil |
| 2009/0065301 | A1 | | 3/2009 | Ellement |

* cited by examiner

*Primary Examiner* — Sang Kim
*Assistant Examiner* — Juan Campos, Jr.
(74) *Attorney, Agent, or Firm* — Bracewell & Giuliani LLP; Constance Gall Rhebergen

(57) ABSTRACT

An access system for facilitating access to an elevated deck of a mobile crane includes a staircase having a support post defining an axis of inclination. A plurality of ascending steps is connected to the at least one support post, and a mounting bracket is pivotally coupled to an upper end of the at least one support post. The staircase is pivotable about a longitudinal axis such that a lower end of the at least one support post is induced to move in a lateral direction in response to pivotal motion of the at least one support post. A caster is coupled to the lower end of the support post for supporting the staircase on a ground surface. The caster supports the staircase on the ground surface throughout longitudinal movements of the staircase and lateral movements of the staircase induced by vertical movements of the mobile crane.

17 Claims, 5 Drawing Sheets

CRANE ACCESS STAIRCASE AND MOUNTING SYSTEM

BACKGROUND OF THE INVENTION

1. Field of the Invention

The present invention relates in general to providing operator access to elevated portions of mobile crane systems. More specifically, the invention relates to an access system including a staircase that is selectively attachable to a deck of a mobile crane system for providing access to an operator's cabin throughout the use of the crane system at a job site.

2. Description of the Related Art

Mobile crane systems are often designed to operate both as cranes for lifting loads and as vehicles capable of moving in normal road traffic. These mobile crane systems generally include an undercarriage supporting a driver's cabin at a forward end thereof, from which a driver operates a steering wheel, turn signals, and the normal implements for operating a vehicle in traffic. Behind the driver's cabin, an upper carriage is often rotatably mounted on a deck of the undercarriage. The upper carriage generally includes a boom that can be lifted and lowered, various winches and hoisting cables, and on operator's cabin from which an operator controls the boom, winches, and other components of the crane system. The operator's cabin is generally elevated and positioned on a lateral side of the upper carriage to provide visibility for the operator and to provide space for the boom to be lowered for traveling.

A vertical ladder is often built into the undercarriage, or provided with the crane system as a pivot attachment to the undercarriage. These vertical ladders generally do not extend a significant lateral distance from the undercarriage, and thus, do not pose a hazard to road traffic adjacent the mobile crane system while travelling. The vertical ladders are provided in various locations including directly under, or slightly forward of a door to the operator's cabin. To gain access to the operator's cabin, an operator must climb the vertical ladder, and rely on various handholds on the deck and on the exterior of the operator's cabin for support. From the vertical ladder, the operator must lean right to slide open the door, and either pull himself or swing himself into the operator's cabin. Opening the door often involves shifting the operator's center of gravity well to the side beyond the deck of the crane or the edge of the support ladder to provide the momentum to open the door. During this motion, the operator is frequently standing on the outer edge of the deck or on a rung of the ladder while using one hand to hold onto a fixed handhold at a different location, with or without gloves. At times, operators may use both hands to open a door when the door does not open easily. The operator is susceptible to falls while opening the door or entering the cabin, as his full weight is borne on one of the hand holds at a time when he is generally off balance transitioning into the operator's cabin or leaning against the door to open it.

SUMMARY OF THE INVENTION

Described herein is an access system including a staircase that is selectively attachable to a deck of a mobile crane system to provide safer access to the operator's cabin. The staircase extends laterally from the deck of the mobile crane system to position an operator for ready entry into the operator's cabin, and includes handrails for additional support. The staircase accommodates various movements of the crane during operation, and mounting features of the staircase allow the staircase to be moved to various positions along the deck to provide access to other areas on the mobile crane system.

According to one aspect of the invention, an access system for facilitating access to an elevated portion of a mobile crane includes a mounting bracket for coupling to the elevated portion of the mobile crane. The access system also includes a staircase having at least one support post defining an axis of inclination and upper and lower ends, and a plurality of ascending steps connected to the at least one support post. The staircase is operable to pivotally couple the upper end of the at least one support post to the mounting bracket such that the staircase is pivotable about a longitudinal axis generally orthogonal to the axis of inclination such that the lower end of the at least one support post is induced to move in a lateral direction in response to pivotal motion of the at least one support post. The staircase is also operable to decouple the upper end of the at least one support post from the mounting bracket. The access system also includes a caster coupled to the lower end of the at least one support post for supporting the staircase on a ground surface when the mounting bracket is coupled to the elevated portion of the mobile crane and the upper end of the at least one support post is pivotally coupled to the mounting bracket.

In some embodiments, a mounting rail is operable to be coupled to the mounting bracket to extend in a longitudinal direction along the longitudinal axis when the mounting bracket is coupled to the elevated portion of the mobile crane, and the staircase is selectively movable along the mounting rail in the longitudinal direction. In some embodiments, the staircase further includes a hook extending from the upper end of the at least one support post. The hook is extendable over the mounting rail to pivotally coupled the upper end of the at least one support post to the mounting bracket, and the hook abuts the mounting rail to provide sliding frictional resistance to longitudinal motion of the staircase when the hook extends over the mounting rail. In some embodiments, the access system further includes a lock operatively associated with the hook to selectively prohibit decoupling of the hook from the mounting rail, and in some embodiments, the caster is a swivel caster operable to align itself with at least a lateral direction of motion and an orthogonal longitudinal direction of motion. In some embodiments, the access system further includes a first handrail coupled to the at leas tone support post, and the first handrail is selectively movable between a deployed orientation wherein the first handrail extends upwardly from the at least one support post and a folded orientation wherein the first handrail lies flat against the at least one support post. In some embodiments, a lower end of the first handrail is disposed at a first elevation above the support post and an upper end of the first handrail is disposed at a second elevation above the support post that is less than the first elevation. In some embodiments, a second handrail is coupled to the at least one support post, and the second handrail includes an upper end disposed at an elevation that is greater than an elevation of the upper end of the first handrail.

According to another aspect of the invention, a mobile crane includes an access system for facilitating access to elevated areas of the mobile crane. The mobile crane includes an undercarriage supportable on a ground surface and defining an elevated deck with respect to the ground surface. Outriggers are operatively coupled to the undercarriage to raise and lower the undercarriage in a vertical direction relative to the ground surface. A mounting bracket is secured to the elevated deck of the undercarriage, and a staircase is pivotally coupled to the mounting bracket. The staircase extends from the undercarriage in a lateral direction and includes at least one support post defining upper and lower ends, a plurality of ascending steps connected to the at least one support post, and a caster coupled to the lower end of the at least one support post. The caster moves along the ground surface in the lateral direction in response to vertical motion of the undercarriage.

In some embodiments, the mobile crane further includes a mounting rail coupled to the mounting bracket and extending in a longitudinal direction along a longitudinal axis that is substantially orthogonal to the lateral direction. The staircase is selectively movable along the mounting rail in the longitudinal direction. In some embodiments, the mobile crane further includes a driver's cabin disposed on the undercarriage from which the mobile crane is operable in road traffic, and an upper carriage supported on the elevated deck of the undercarriage, wherein the upper carriage includes a selectively pivotable boom and an operator's cabin from which the selectively pivotable boom is operable.

In some embodiments, upper stepping surfaces of the plurality of ascending steps slope downward when the mobile crane is arranged in a fast configuration wherein the elevated deck is disposed at a first elevation above the ground surface. And in some embodiments, the upper stepping surfaces of the plurality of ascending steps are substantially horizontal with respect to the ground surface when the mobile crane is disposed in a second configuration wherein the elevated deck is disposed at a second elevation above the ground surface that is greater than the first elevation.

According to another aspect of the invention, a method of using the mobile crane includes (i) delivering the mobile crane to a job site with the mounting bracket secured to the elevated deck and the staircase disengaged from the mounting bracket, (ii) coupling the staircase to the mounting bracket at the job site such that the caster engages the ground surface, (iii) subsequently to coupling the staircase to the mounting bracket, deploying the outriggers to induce vertical movement of the undercarriage and corresponding lateral movement of the caster along the ground surface, and (iv) ascending the staircase.

According to another aspect of the invention, a mobile crane includes an undercarriage supportable on a ground surface and defining an elevated deck with respect to the ground surface. The elevated deck is selectively movable in a vertical direction with respect to the ground surface, and a mounting bracket is secured to the elevated deck of the undercarriage. A staircase, is pivotally coupled to the mounting bracket and extends from the undercarriage in a lateral direction such that the staircase engages the ground surface when the mobile crane is arranged in a first configuration wherein the elevated deck is disposed at a first elevation above the ground surface and also when the mobile crane is disposed in a second configuration wherein the elevated deck is disposed at a second elevation above the ground surface that is greater than the first elevation. In some embodiments, the staircase includes a caster secured to a lower end thereof for engaging the ground surface.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
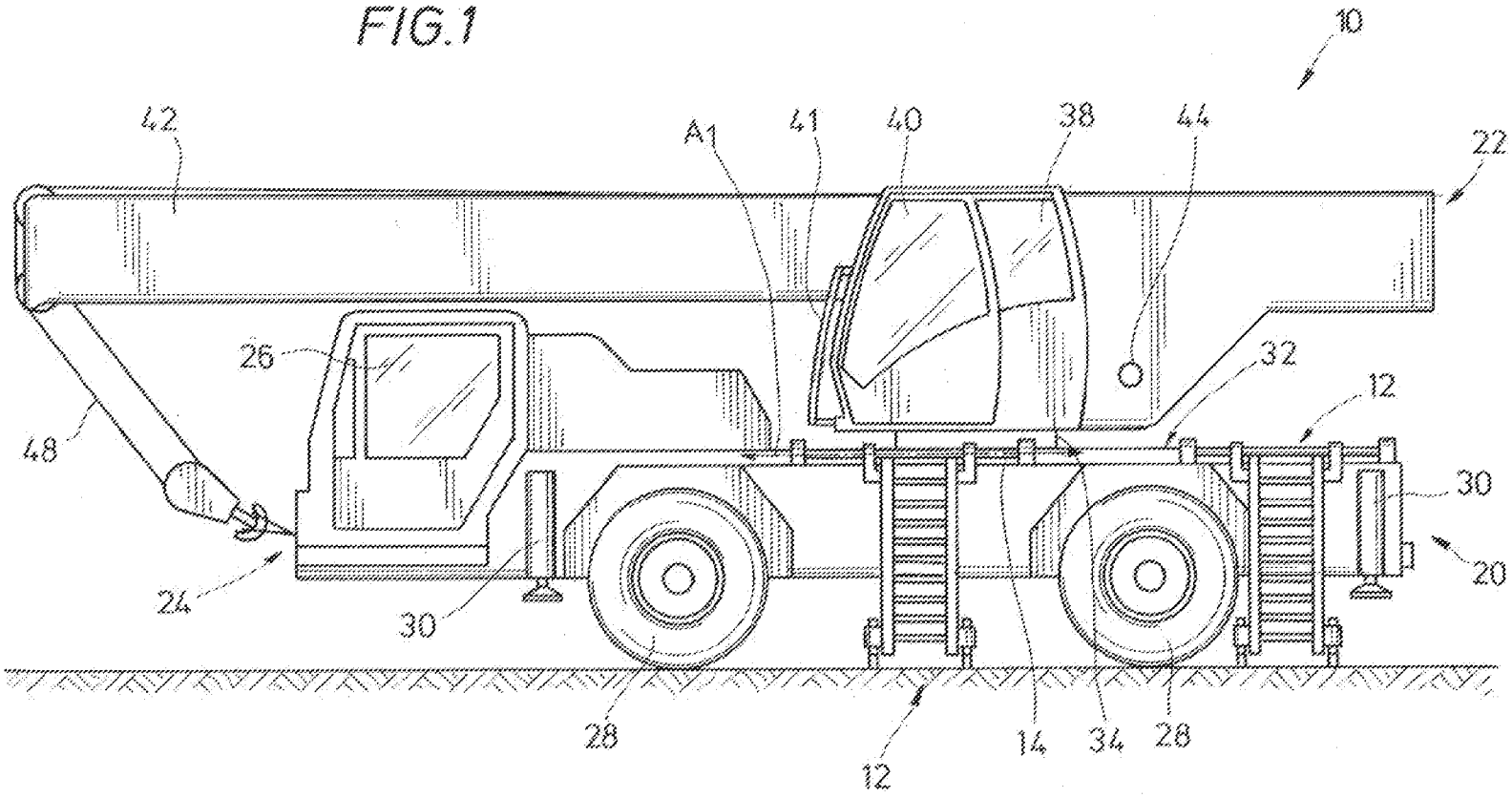
FIG. 1 is a side view of a mobile crane system including a pair of mounting rails coupled thereto, and a respective staircase mounted to each of the mounting rails, in accordance with one embodiment of the present invention.

Referring generally to FIG. 1, shown in side view is an example embodiment of a mobile crane system 10 provided with a plurality of staircases 12 for accessing elevated portions of the mobile crane system 10. The staircases 12 are provided in addition to vertical ladders 150 (see FIG. 5), winch are often provided with mobile crane systems in accordance with standard practices in the industry. A mounting rail 14 defines a longitudinal axis A1 and is provided, for mounting the respective staircase 12 to the mobile crane system 10 in accordance with an example embodiment of the present invention as described in greater detail below.

The mobile crane system 10 includes an undercarriage 20 and an upper carriage 22. The undercarriage 20 includes a vehicle base 24 having a driver's cabin 26 at a forward end thereof, from which the mobile crane system 10 is operated in road traffic. Vehicle tires 28 support the mobile crease system 10 in traffic, while outriggers 30 are provided on laterally outward sides of the undercarriage 20 for supporting the crane system 10 when operated as a crane to lift loads. The vehicle base 24 defines a deck 32 that is a generally flat platform that supports the upper carriage 22.

The upper carriage 22 is arranged on a rotatable turret 34 on the deck 32 that permits the upper carriage 22 to rotate 360 degrees. An operator's cabin 38 includes a door 40, and is positioned on the turret 34, generally at an upper end of one of the staircases 12. A hand hold 41 is secured to an outer surface of the operator's cabin 38 to facilitate entry into the operator's cabin 38. A telescoping boom 42 is pivotally mounted about a pivot axis 44, about which the boom 42 is selectively raised and lowered. A hoist cable 48 is supported by the telescoping boom 42 and is operatively associated with a winch or other mechanism for lining loads.

Figure 2B:
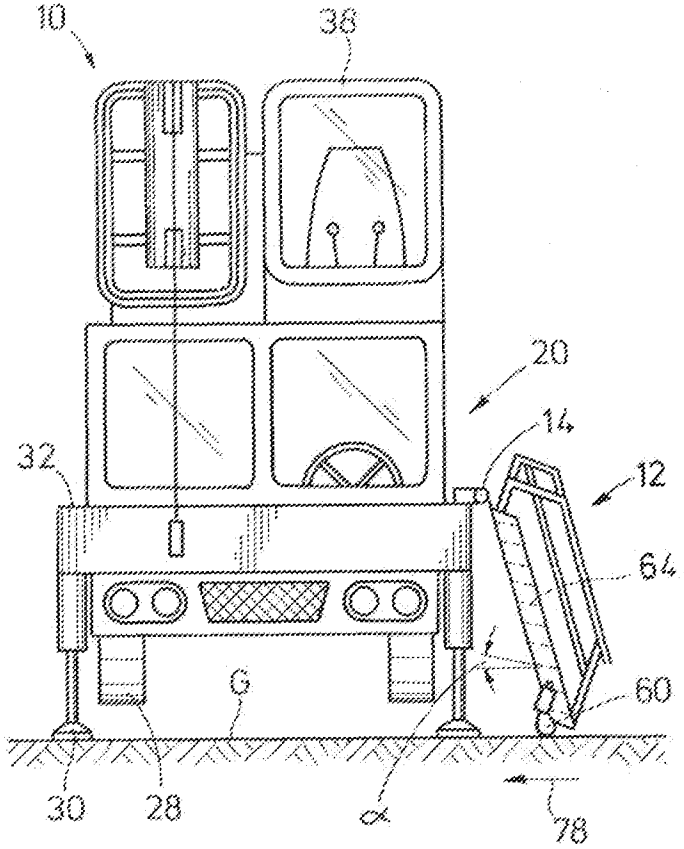
FIG. 2B is a front view of the mobile crane system of FIG. 2A with the respective staircase mounted to the mounting rail while the mobile crane system is in a second configuration supported on the ground surface by outriggers of the mobile crane system.
Figure 2A:
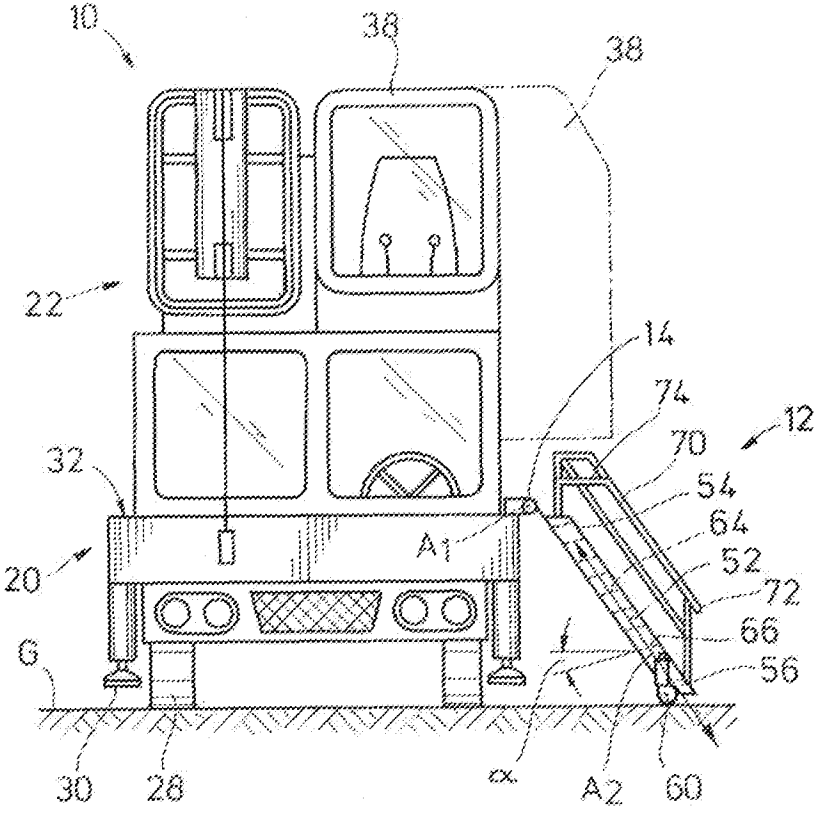
FIG. 2A is front view of the mobile crane system of FIG. 1 with the respective staircase mounted to one of the mounting rails while the mobile crane system is in a first configuration supported on a ground surface by vehicle tires of the mobile crane system.

Referring now to FIG. 2A, one of the staircases 12 is attached to the deck 32 of the lower carriage 20 when the mobile crane system 10 is arranged in a first configuration supported by the vehicle tires 28 on a ground surface "G." The staircase 12 includes a pair of support posts 52 which define an axis of inclination A2, which is substantially normal to the longitudinal axis A1 of the mounting rail 14. The support posts 52 extend substantially from the deck 32 in a lateral direction, and also define an upper end 54 and a lower end 56. In this example embodiment, the support posts 52 are generally straight rigid members. In other embodiments (not shown) the support posts 52 define a framework or lattice structure. The upper ends 54 of the support posts are pivotally coupled to the mounting rail 14 for rotation about the longitudinal axis A1. The lower ends 56 of the support posts 52 are coupled to casters 60 arranged to roll along the ground surface "G" in response to pivotal motion of the of the support posts 52. In this example embodiment, the casters 60 are swivel casters operable to align themselves with a direction of motion, although fixed casters are also envisioned for other embodiments.

A plurality of ascending steps 64 (shown in phantom) extend between the support posts 52. Each of the ascending steps 64 includes an upper stepping surface 66 thereon. The upper stepping surfaces 66 are generally flat, and define an angle "α" with the horizontal. When the mobile crane system 10 is arranged in the first configuration, the upper stepping surfaces 66 slope downward toward the mobile crane system 10 such that the angle "α" is in the range of about 5 degrees to about 25 degrees. In this example embodiment, the upper stepping surfaces 66 are roughly textured to provide traction for an operator ascending or descending the staircase 12.

The staircase 12 includes a first handrail 70 projecting upwardly from the upper and lower ends 54, 56 of one of the support posts 52. A lower end 72 of the first handrail 70 is disposed at a first elevation above the support post 52 that is convenient for an operator to hold by hand when stepping on lower steps 64. An upper end 74 of the first handrail 70 is disposed at a second elevation above the support post 52 that is less than the first elevation. The upper end 74 of the first handrail 70 is generally horizontal to provide clearance for the operator's cabin 38 (shown in phantom) or other components of the upper carriage 22 when rotated on the turret 34 (FIG. 1). The first handrail 70, and additional handrails are described in greater detail below with reference to FIGS. 5-7.

Referring now to FIG. 2B, the staircase 12 is depicted as attached to the deck 32 of the lower carriage 20 when the mobile crane system 10 is arranged in a second configuration supported by the outriggers 30 on the ground surface "G." When the mobile crane system 10 is arranged in the second configuration, the deck 32 is generally disposed at an elevation with respect to the ground surface "G" that is about one (1) foot higher than when the mobile crane system 10 is in the first configuration (see FIG. 2A). This upward change in elevation induces the staircase 12 to pivot about the longitudinal axis A1, which is substantially normal to the axis of inclination A2, and induces the lower end 56 of the support posts 52 move toward the mobile crane system 10 in the direction of arrow 78. The casters 60 roll along the ground surface "G" such that the staircase 12 is supported on the ground surface "G" irrespective of whether the mobile crane system 10 is in the first or second configuration, or in between. Ground support of the staircase 12, coupled with support of the staircase 12 by mounting rail 14 on the deck 32, provides stability to the staircase 12 as compared to a ladder (not shown) suspended only from an upper end thereof.

The upper stepping surfaces 66 of the ascending steps 64 are substantially horizontal when the mobile crane system 10 is arranged in the second configuration. In other embodiments (not shown), upper stepping surfaces 66 slope upward toward the mobile crane system 10 when the mobile crane system 10 is arranged in the second configuration such that the angle "α" (see FIG. 2A) is in the range of about 0 degrees to about 10 degrees.

Figure 3:
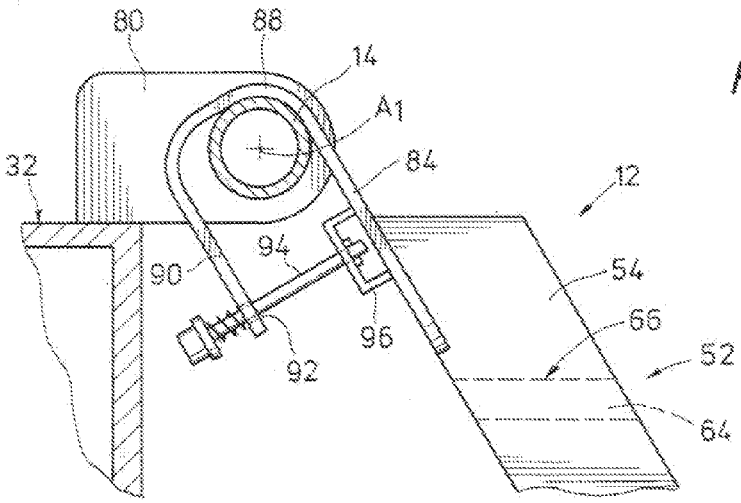
FIG. 3 is a partial, cross-sectional view of one of the mourning rail of FIGS. 2A and 2B with the respective staircase mounted thereon.
Figure 4:
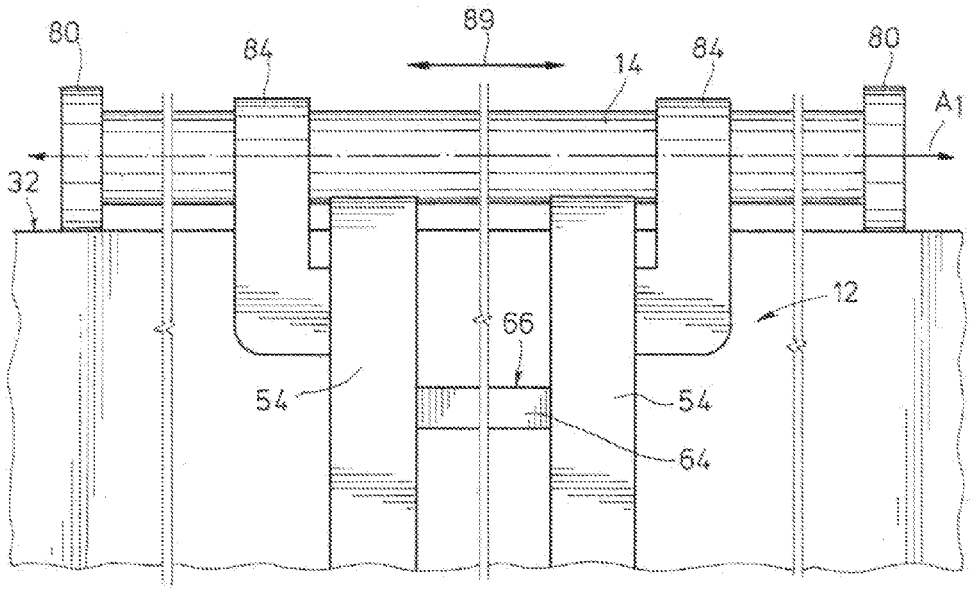
FIG. 4 is a front view of the mounting rail and staircase of FIG. 3.

Referring now to FIGS. 3 and 4, the coupling between the staircase 12 and the mounting rail 14 is described in greater detail. A pair of mounting brackets 80 is fixedly coupled to the deck 32 by a welded connection, fasteners or other mechanisms generally known in the art. The mounting brackets 80 support the mounting rail 14 above, and to a lateral side of the deck 32 as illustrated in FIG. 3. In other embodiments, a mounting rail 14 is supported in other locations such as to a lateral side of the deck 32 (see, e.g., FIG. 5), or directly above the deck 32. In this example embodiment, the mounting rail 14 is a generally circular tabular member as depicted, although other shapes are contemplated for use in other embodiments (not shown).

A pair of hooks 84 extend from upper ends of the support posts 52 and over the mounting rail 14. Curved portions 88 of hooks 84 pivotally engage the mounting rail 14 such that the support posts 52 are pivotally coupled to the mounting brackets 80. The hooks 84 also permit the staircase 12 to translate longitudinally along the mounting rail 14 in the direction of arrows 89 as depicted in FIG. 4. Although the hooks 84 permit longitudinal motion of staircase along the mounting rail 14, a substantial portion of the hooks are in abutment with the mounting rail 14 to provide sliding frictional resistance to longitudinal motion of the staircase 12. This frictional resistance facilitates maintaining the staircase in a fixed longitudinal position when ascending or descending the staircase 12. The longitudinal direction of arrows 89 is substantially orthogonal to the lateral direction of arrow 78 (FIG. 2B). The casters 60 (FIG. 2A) also facilitate this longitudinal translation of the staircase 12 as the casters 60 roll longitudinally along the ground surface "G" (FIG. 2A). A terminal portion 90 of the hooks 84 include a bore 92 through which a lock 94 extends. The lock 94 is in the form of a locking pin operable to selectively engage a keeper 96 disposed on an underside of the hook 84 and/or support post 52. When the locks 94 are installed as depicted in FIG. 3, the hooks 84 are prevented from decoupling from the mounting rail 14. The lock 94 is operable to selectively disengage the keeper 96 such that the lock 94 is removable from the keeper 96 and the bore 92 to permit the decoupling of the of the hooks 84 from the mounting rail 14, and thereby decoupling the staircase 12 from the mounting rail 14.

In one example embodiment of use, the mounting rail 14 is coupled to the deck 32, and the mobile crane system 10 (FIG. 1) is driven to a job site in normal road traffic. Once in position at the job site, the mobile crane system 10 remains substantially stationary for the duration of a job, often twenty (20) days or more. The hooks 84 (FIG. 3) are engaged with the mounting rail 14, and the locking pin 94 is installed to secure the staircase 12 to the mobile crane system 10 at the job site. An operator then ascends the staircase 12 to gain access to the operator's cabin 38. Since the staircase 12 projects laterally from the deck 32, the operator opens the door 40 (FIG. 1) from a stable position directly in front of the door 40. The mobile crane system 10 is then transitioned from the first configuration (FIG. 2A) to the second configuration (FIG. 2B) by deploying the outriggers 30. The lower ends 56 of the support posts 52 are induced to roll on the casters 60 in the lateral direction of arrow 78 (FIG. 2B). With the operator in the operator's cabin 38, support personnel translate the staircase 12 along the mounting rail 14 to gain access to other portions the deck 32. The lower ends 56 of the support posts 52 are induced to roll on the casters 60 in the lateral direction of arrow 89.

The staircase 12 remains coupled to mobile crane system 10 for the duration of the job. The staircase 12 is both translated longitudinally and pivoted about the axis A1 for many instances throughout the job. At all times, the casters 60 support the staircase 12 on the ground surface "G."

Figure 5:
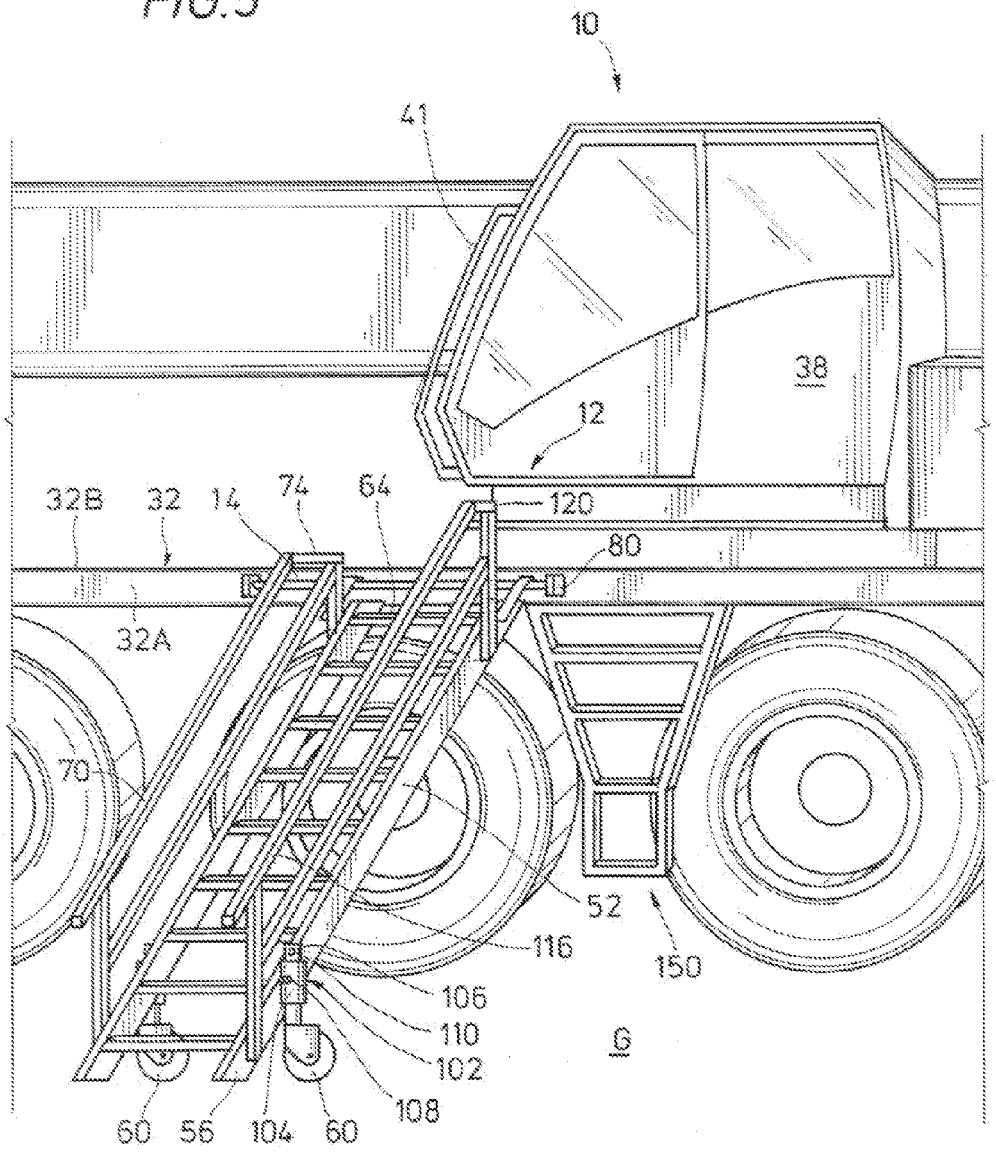
FIG. 5 is a perspective view of the mounting rail and staircase of FIG. 3 mounted on a mobile crane system in an alternate configuration.

Referring now to FIG. 5, the staircase 12 is depicted as attached to the deck 32 in an alternate configuration. The mounting brackets 80 are secured to a generally vertical surface 32A of the deck 32, and the mounting rail 14 extends alongside the deck 32. This configuration permits a horizontal surface 32B of the deck 32 to remain substantially unencumbered by the staircase 12. In the configuration depleted in FIG. 5, the mounting tail 14 is disposed at lower elevation than when the mounting brackets are secured to a horizontal surface 32B of the deck 32. The mounting rail 14 will also be disposed at a different elevation when mounted to an alternate embodiment mobile crane system (not shown) with a deck 32 disposed at different elevation. To accommodate differences in the elevation of the mounting rail 14, an adjustment mechanism 102 is provided adjacent each of the casters 60.

The adjustment mechanisms 102 include sleeves 104 secured to lower ends 56 of the support posts 52. An elongated support member 106 is received within each of the sleeves 104, and is coupled to a respective caster 60. Pins or 108 are selectively positionable to extend through the sleeves 104 into one of a plurality of vertically spaced holes 110 defined in the elongated support member 106. The particular hole 110 selected defines the distance the caster 60 extends below the lower end 56 of the respective support post 52. Thus, the adjustment mechanism 102 permits the casters 60 to support the staircase 12 on the ground surface "G" for a variety of initial elevations of the mounting rail 14.

As depicted in FIG. 5, the first handrail 70 is positioned on a left side of the staircase 12 from the perspective of at operator ascending the staircase 12, or toward a forward end of the mobile crane system 10. The upper end 74 of the first handrail 70 is substantially level with the horizontal surface 32B of the deck 32, and thus, facilitates operator access to the horizontal surface 32B of the deck 32. The elevation of the upper end 74 of the first handrail 70 also permits rotation of the operator's cabin 38 as indicated above. A second handrail 116 is positioned on a right side of the staircase 12 from the perspective of an operator ascending the staircase 12, or toward a rearward end of the mobile crane system 10. An upper end 120 of the second handrail 116 is disposed at an elevation that is higher than the elevation of the upper end 74 of the first handrail 70. The upper end 120 of the handrail 116 is disposed at an elevation that is convenient for an operator to hold by hand when stepping on upper steps 64. The hand hold 41 is also accessible to an operator stepping on upper steps 64.

A vertical ladder 150 is depicted, which extends downward from the deck 32. Vertical ladder 150 is an example the type of access device that is often provided with mobile crane systems in accordance with standard practices in the industry. In some embodiments, the staircase 12 obstructs access to the vertical ladder 150, thereby encouraging use of the staircase 12 over the vertical ladder 150.

Figure 7:
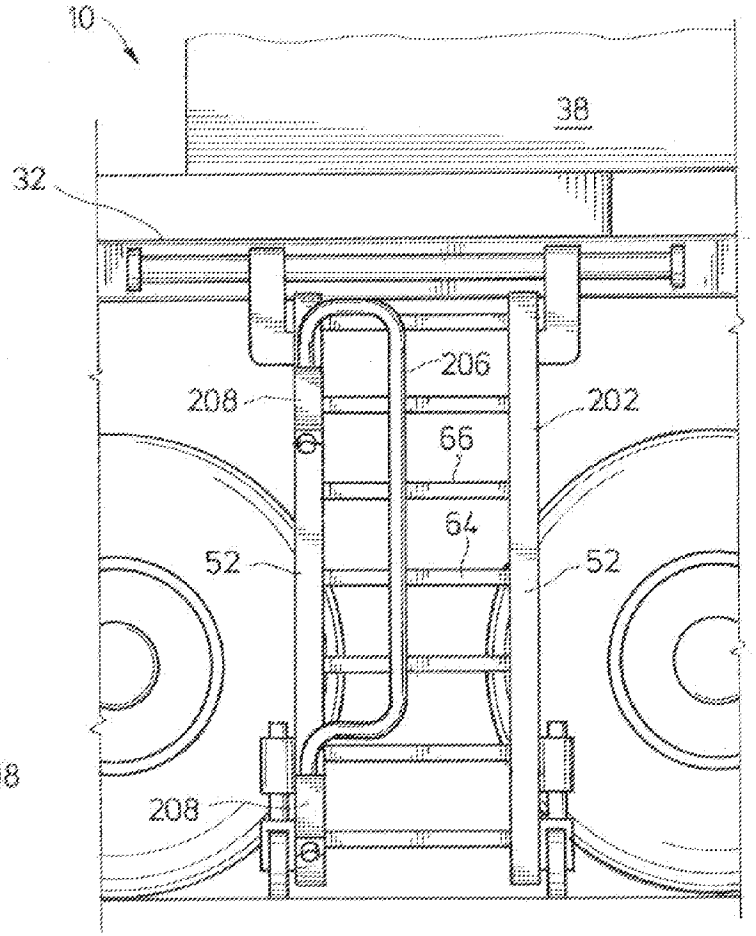
FIG. 7 is a perspective view of the access system of FIG. 6 with the foldable handrail in a folded orientation.
Figure 6:
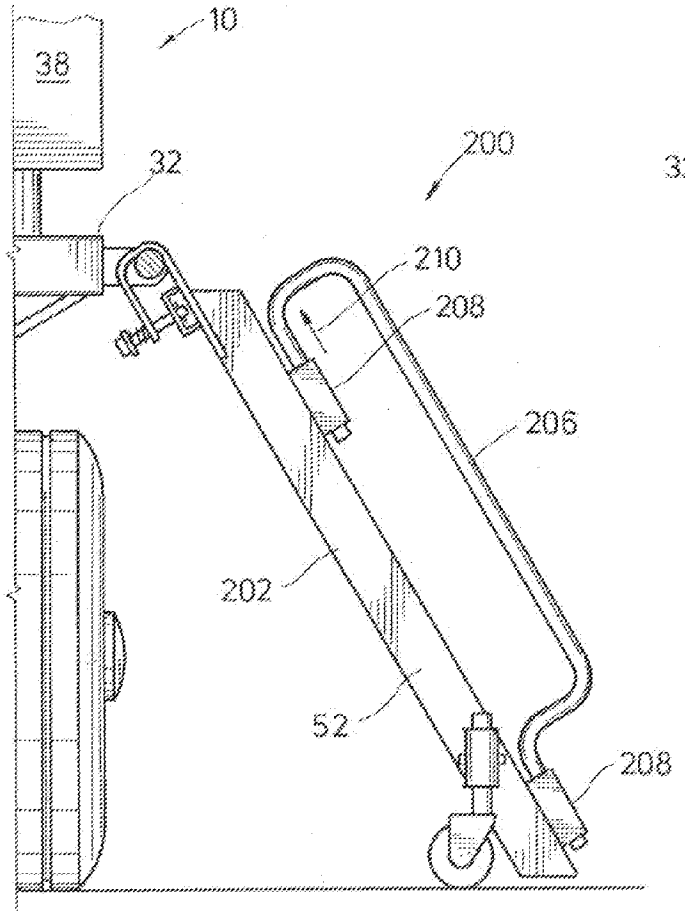
FIG. 6 is a perspective view of an access system including a foldable handrail in a deployed orientation in accordance with an alternate embodiment of the present invention.

Referring now to FIGS. 6 and 7, an alternate embodiment of an access system 200 is depicted mounted to the deck 32 of the mobile crane system 10. The access system 200 includes a staircase 202 including a pair of support posts 52 and a plurality of steps 64 extending therebetween. Upper stepping surfaces 66 are textured to provide traction for an operator ascending the staircase 202.

A folding handrail 206 is provided on the staircase 202. The handrail 206 is selectively movable between a deployed orientation (FIG. 6) wherein the handrail 206 extends upwardly from one of the support posts 52 and a folded orientation (FIG. 7) wherein the handrail 206 lies flat against the support post 52. The handrail 206 is coupled to one of the support posts 52 by keyed couplers 208. The keyed couplers 208 prohibit rotational movement of the handrail 106 when in a downward position as depicted in FIGS. 6 and 7, but permit rotational movement between the deployed orientation (FIG. 6) and the folded orientation (FIG. 7) when induced to move upward in the direction of arrow 210. The handrail 206 is moved into the deployed orientation for use, and into the folded orientation for transport and storage. Various other hinge mechanisms are also envisioned for selectively folding the handrail 206.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. In addition, unless mention was made above to the contrary, it should be noted that all of the accompanying drawings are not to scale. These and other similar modifications will readily suggest themselves to those skilled in the art, and are intended to be encompassed within the spirit of the present invention disclosed herein and the scope of the appended claims.

What is claimed is:

1. An access system for facilitating access to an elevated portion of a mobile crane, the access system comprising:

a mounting bracket for coupling to the elevated portion of the mobile crane;

a staircase having at least one support post defining an axis of inclination and upper and lower ends, and a plurality of ascending steps connected to the at least one support post, wherein the staircase is operable to pivotally couple the upper end of the at least one support post to the mounting bracket such that the staircase is pivotable about a longitudinal axis generally orthogonal to the axis of inclination such that the lower end of the at least one support post is induced to move in a lateral direction in response to pivotal motion of the at least one support post, and wherein the staircase is operable to decouple the upper end of the at least one support post from the mounting bracket; and a caster coupled to the lower end of the at least one support post for supporting the staircase on a ground surface when the mounting bracket is coupled to the elevated portion of the mobile crane and the upper end of the at least one support post is pivotally coupled to the mounting bracket.

2. The access system of claim 1, further comprising a mounting rail operable to be coupled to the mounting bracket to extend it a longitudinal direction along the longitudinal axis when the mounting bracket is coupled to the elevated portion of the mobile crane.

3. The access system of claim 2, wherein the staircase is movable along the mounting rail in the longitudinal direction.

4. The access system of claim 3, wherein the staircase comprises a hook extending from the upper end of the at least one support post, the hook extendable over the mounting rail to pivotally couple the upper end of the at least one support post to the mounting bracket, and wherein the hook abuts the mounting rail to provide sliding frictional resistance to longitudinal motion of the staircase when the hook extends over the mounting rail.

5. The access system of claim 4, further comprising a lock operatively associated with the hook to selectively prohibit decoupling of the hook from the mounting rail.

6. The access system of claim 1, wherein the caster is a swivel caster operable to align said swivel caster with at least a lateral direction of motion and an orthogonal longitudinal direction of motion.

7. The access system of claim 1, further comprising a first handrail coupled to the at least one support post.

8. The access system of claim 7, wherein the first handrail is selectively movable between a deployed orientation wherein the handrail extends upwardly from the at least one support post and a folded orientation wherein the first handrail lies flat against the at least one support post.

9. The access system of claim 7, wherein a lower end of the first handrail is disposed at a first elevation above the support post and an upper end of the first handrail is disposed at a second elevation above the support post, wherein the second elevation above the support post is less than the first elevation above the support post.

10. The access system of claim 7, further comprising a second handrail coupled to the at least one support post, wherein the second handrail includes an upper end disposed at an elevation that is greater than an elevation of the upper end of the first handrail.

11. A mobile crane including an access system for facilitating access to an elevated portion of the mobile crane; the mobile crane comprising:

an undercarriage supportable on a ground surface and defining an elevated deck with respect to the ground surface;

outriggers operatively coupled to the undercarriage to raise and lower the undercarriage in a vertical direction relative to the ground surface; and the access system comprising:

a mounting bracket secured to the elevated deck of the undercarriage;

a mounting rail coupled to the mounting bracket and extending in a longitudinal direction along a longitudinal axis that is substantially orthogonal to the lateral direction, and wherein a staircase is selectively movable along the mounting rail in the longitudinal direction; and the staircase pivotally coupled to the mounting bracket and extending from the undercarriage in a lateral direction, the staircase comprising:

at least one support post defining upper and lower ends;

a plurality of ascending steps connected to the at least one support post; and a caster coupled to the lower end of the at least one support post such that the caster moves along the ground surface in the lateral direction in response to vertical motion of the undercarriage.

12. The mobile crane according to claim 11, further comprising a driver's cabin disposed on the undercarriage from which the mobile crane is operable in road traffic.

13. The mobile crane according to claim 12, further comprising an upper carriage supported on the elevated deck of the undercarriage, wherein the upper carriage includes a selectively pivotable boom and an operator's cabin from which the selectively pivotable boom is operable.

14. The mobile crane according to claim 11, wherein upper stepping surfaces of the plurality of ascending steps slope downward when the mobile crane is arranged in a first configuration wherein the elevated deck is disposed at a first elevation above the ground surface.

15. The mobile crane according to claim 14, wherein the upper stepping surfaces of the plurality of ascending steps are substantially horizontal with respect to the ground surface when the mobile crane is disposed in a second configuration wherein the elevated deck is disposed at a second elevation above the ground surface that is greater than the first elevation.

16. A method of using the mobile crane of claim 11, the method comprising:

delivering the mobile crane to a job site with the mounting bracket secured to the elevated deck and the staircase decoupled from the mounting bracket;

coupling the staircase to the mounting bracket at the job site such that the caster engages the ground surface;

subsequently to coupling the staircase to the mounting bracket, deploying the outriggers to induce vertical movement of the undercarriage and corresponding lateral movement of the caster along the ground surface; and ascending the staircase.

17. A mobile crane comprising:

an undercarriage supportable on a ground surface and defining an elevated deck with respect to the ground surface, wherein the elevated deck is selectively movable in a vertical direction with respect to the ground surface;

a mounting bracket secured to the elevated deck of the undercarriage; and a staircase pivotally coupled to the mounting bracket and extending from the undercarriage in a lateral direction such that the staircase engages the ground surface when the mobile crane is arranged in a first configuration wherein the elevated deck is disposed at a first elevation above the ground surface and also when the mobile crane is disposed in a second configuration wherein the elevated deck is disposed at a second elevation above the ground surface that is greater than the first elevation, wherein the staircase includes a caster secured to a lower end thereof for engaging the ground surface.

* * * * *